US009649760B2

(12) United States Patent
Klimsza

(10) Patent No.: US 9,649,760 B2
(45) Date of Patent: May 16, 2017

(54) WRENCH EXTENDER

(71) Applicant: David Klimsza, Wolverine, MI (US)

(72) Inventor: David Klimsza, Wolverine, MI (US)

( * ) Notice: Subject to any disclaimer, the term of this patent is extended or adjusted under 35 U.S.C. 154(b) by 279 days.

(21) Appl. No.: 14/535,369

(22) Filed: Nov. 7, 2014

(65) Prior Publication Data

US 2016/0129580 A1 May 12, 2016

(51) Int. Cl.
*B25G 1/04* (2006.01)
*B25G 3/24* (2006.01)

(52) U.S. Cl.
CPC ..... *B25G 1/043* (2013.01); *B25G 3/24* (2013.01)

(58) Field of Classification Search
CPC ..... B25G 1/005; B25G 1/043; B25G 3/24; B25G 3/28
USPC ..... 81/177.2
See application file for complete search history.

(56) References Cited

U.S. PATENT DOCUMENTS 1,643,027 A * 9/1927 Morgan ..... B25G 1/025 81/177.2
1,689,639 A * 10/1928 Neff ..... B25B 13/08 81/177.2
4,644,600 A * 2/1987 Fugate ..... B25B 27/02 7/166
D298,007 S * 10/1988 Williams ..... D8/17
5,528,964 A 6/1996 Smith, Jr.
5,570,617 A 11/1996 Love
6,308,596 B1 * 10/2001 Williams ..... B25G 1/043 81/177.1
6,626,069 B1 9/2003 Cooper
8,931,376 B2 * 1/2015 Humphrey ..... B25G 1/043 81/177.2

* cited by examiner

*Primary Examiner* — Hadi Shakeri
(74) *Attorney, Agent, or Firm* — Northern Michigan Patent Law, PLC

(57) ABSTRACT

A wrench extender useful for extending both the reach and leverage of most double-ended wrenches. The extender includes a flat base with spaced clamping receptacles for receiving and securing a wrench handle, the receptacles selectively closed with clamping means locking the wrench handle in the receptacles with a compressive and/or frictional fit. The wrench is further secured by its inner non-free end in a downwardly-angled neck or relief connecting the wrench-supporting base and an aligned grip. In a first form, the neck is provided with a vertical stud for engaging the inner end of the wrench to prevent longitudinal shifting. In a second form, the neck terminates in a vertical wall adjacent the grip to longitudinally stop the inner end of the wrench.

19 Claims, 3 Drawing Sheets

WRENCH EXTENDER

RELATED APPLICATIONS/PRIORITY BENEFIT CLAIM

Not applicable.

FIELD

The subject matter of the present application is in the field of wrench extensions, i.e. devices added to the handle of a one-piece wrench.

BACKGROUND

Extenders for increasing the leverage of one-piece, relatively straight-handled wrenches are known, the most common probably being the ubiquitous length of pipe temporarily slid over the wrench handle.

More sophisticated examples include U.S. Pat. No. 5,570,617 to Love and U.S. Pat. No. 6,626,069 to Cooper.

The Love patent discloses an extendible extension handle for wrenches, ratchets, and tire irons to increase leverage, and uses a tubular inner handle and a telescoping outer handle assembly.

The Cooper patent discloses an angled adapter bar with a U-bolt for receiving the handle of a wrench, and a leverage bar for engaging the other end of the adapter bar, so that when all three are connected they multiply the force applied by the user to the wrench.

The foregoing prior art and other prior wrench extensions seem to focus on increasing leverage more than they address the problem of extending reach. In the case of nuts or bolts deeply recessed in tight places, reach is often the more important factor.

BRIEF SUMMARY

I have invented a wrench extender that increases both leverage and reach, and that works with most types of common one-piece wrenches, including open-end wrenches, combination wrenches, and box-end wrenches (hereafter collectively "wrenches"). My wrench extender can be used with both single- and double-ended wrenches, but is especially advantageous in combination with double-ended wrenches. My wrench extender also accommodates the offset angle of one or both ends of a double-ended wrench.

My wrench extender includes a handle-supporting base having two spaced vertically-opening clamping receptacles on an upper surface of the base for securely holding a wrench handle. The inner end of the base terminates at a downwardly-angled neck defining a combined recess and stop for one end of a double-ended wrench. The inner end of the angled neck is connected to a grip portion that is aligned with the handle-supporting base. If the extender is combined with a double-ended wrench, the outer end of the wrench extends beyond the outer end of the base to engage a nut or bolt, while the inner end of the wrench extends beyond the inner end of the base and is located in the angled neck between the base and the grip.

In a further form, the angled neck includes a ramp portion adjacent the handle-supporting base, the ramp angled downwardly relative to the base corresponding to the angle of an angled end of a double-ended wrench.

In a further form, the angled neck includes a stop in the form of a stud projecting vertically up from the neck to a height at or above the height of the upper surface of the handle-supporting base. In an alternate form, the stop is formed by an inner vertical wall or shoulder formed by the junction of the inner end of the angled neck and the grip.

These and other features and advantages of the invention will become apparent from the detailed description below, in light of the accompanying drawings.

DETAILED DESCRIPTION

Figure 1:
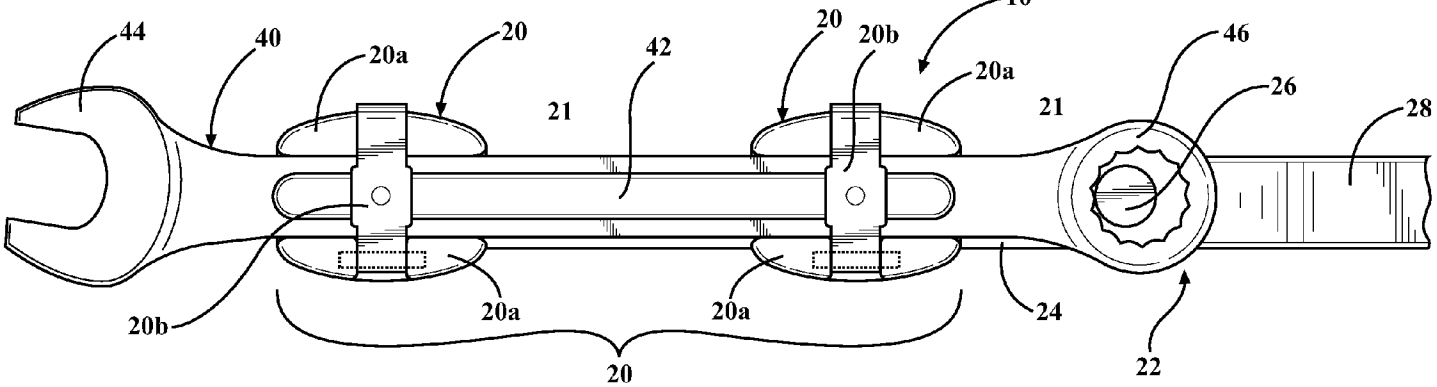
FIG. 1 is a top plan view of an example wrench extender according to the invention, combined with a combination wrench.
Figure 2:
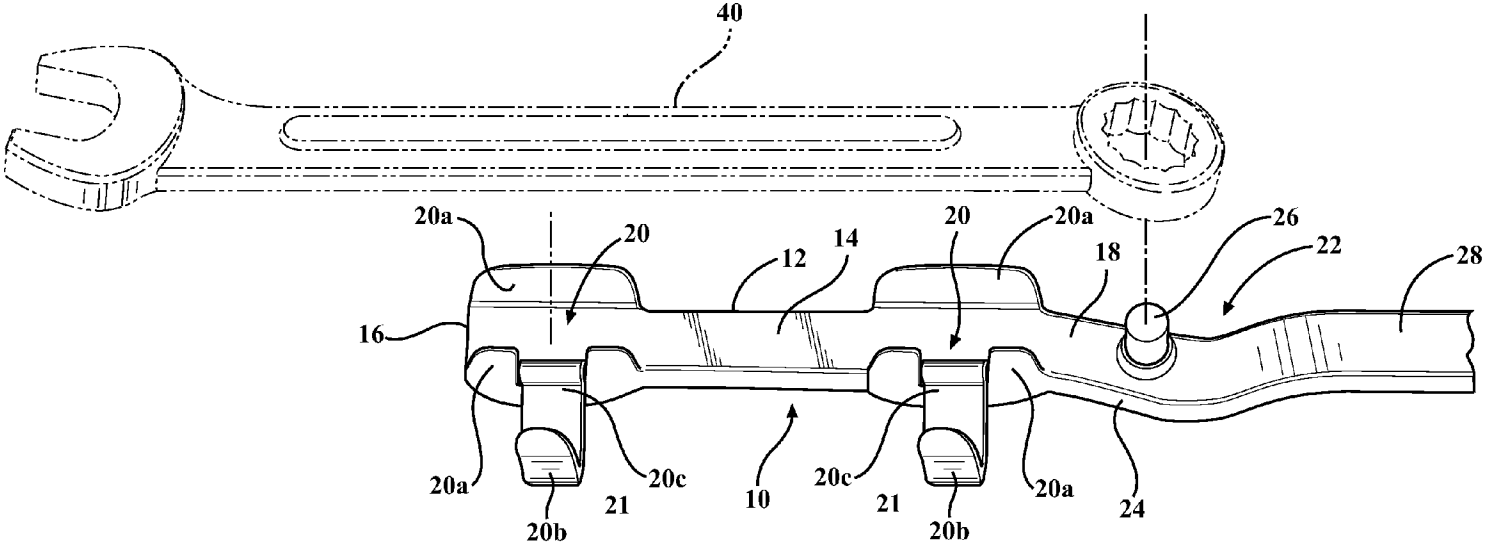
FIG. 2 is a perspective view of the extender of FIG. 1, with the wrench shown exploded from the extender.

Referring first to FIGS. 1 and 2, an exemplary wrench extender according to the invention is shown generally at 10, combined with a combination wrench 40 having a handle 42, an open crescent end 44, and an angled box end 46. In the illustrated example, box end 46 is secured in the extender 10, while open end 44 is free to engage a nut or bolt (not shown).

Extender 10 includes a handle-supporting base 12 with an upper surface 14, an outer end 16, and an inner end 18. In the illustrated example, extender 10 is made from a single piece of durable metal, for example drop-forged steel, although other materials and/or methods of forming are possible: e.g., other metals or plastics formed by machining or molding or casting, and multi-piece constructions.

Extender 10 further includes an elongated clamping receptacle means 20 defining two or more longitudinally-spaced clamping points for a wrench handle. In the illustrated example, receptacle means 20 is formed by two spaced clamping receptacles 20 on the upper surface 14 of base 12. It will be understood that a single elongated receptacle, for example extending over a majority of the length of handle-supporting base 12, could be used in place of the two spaced receptacles 20, and longitudinally spaced regions or ends of the receptacle would define the clamping points where provided with handle-clamping or securing means. However, the spaced receptacles 20 are preferred, with advantages including reduced weight and cost.

Clamping receptacles 20 secure the wrench to the upper surface 14, and transfer leverage force to the sides of the wrench handle 42 when the extender is turned. Clamping receptacles 20 each include a pair of spaced rigid ears or sidewalls 20*a* extending upwardly past surface 14 from the sides of base 12 a height equal to or greater than the top-to-bottom thickness of a corresponding wrench handle, forming a generally U-shaped receptacle for the wrench handle. Each receptacle is provided with an associated securing member 20*b* such as a clasp (illustrated) or strap or equivalent structure for locking the wrench handle to the upper surface 14 of base 12 by closing off the open upper end of the associated receptacle 20. In the illustrated example, securing member 20*b* is a spring clip pivotally secured to one of the sidewalls 20*a* on a first side of base 12, moveable between open and closed positions, and frictionally engaged with the sidewall 20*a* on the other side of base 12 when closed. In the case of a single elongated receptacle, it would be possible to use two or more spaced closure devices such as clips 20*b*, or a single elongated closure device such as an elongated clip 20*b*.

Further in the illustrated example, inner surfaces 20*c* of the spring clips are provided with resilient and/or frictional pads 21 to engage the wrench handle in compression and/or friction when the clips are closed, in order to prevent the wrench handle from moving longitudinally on upper surface 14 of base 12. Alternately, or additionally, pads 21 could be placed on upper surface 14 within receptacles 20. The upper surface 14 of base 12 could also be provided with similar compressible and/or frictional material, such as rubber or high-density foam, or it could be provided with non-slip texturing. Alternately, spring clips 20*b* or other securing means could be contoured or located to directly engage the wrench handle with sufficient compressive force to hold the handle in place without the need for pads or texturing.

Wrench extender 10 has a downwardly-offset neck 22 at the inner end 18 of base 12. Neck 22 includes a downwardly-angled ramp portion 24 approximating or matching the angle of wrench box-end 46 relative to the axis of the wrench handle. Stop 26 in the example of FIG. 2 is a vertical stud extending upwardly to a point higher than the upper surface 14 of base 12, ensuring that the stud extends sufficiently into the box end of the wrench to stop it from moving longitudinally under load. The stud 26 may be formed integrally with the extender, for example by casting, or it may be formed separately and secured in place by known means such as a weld or a mechanical fastener.

Figure 3:
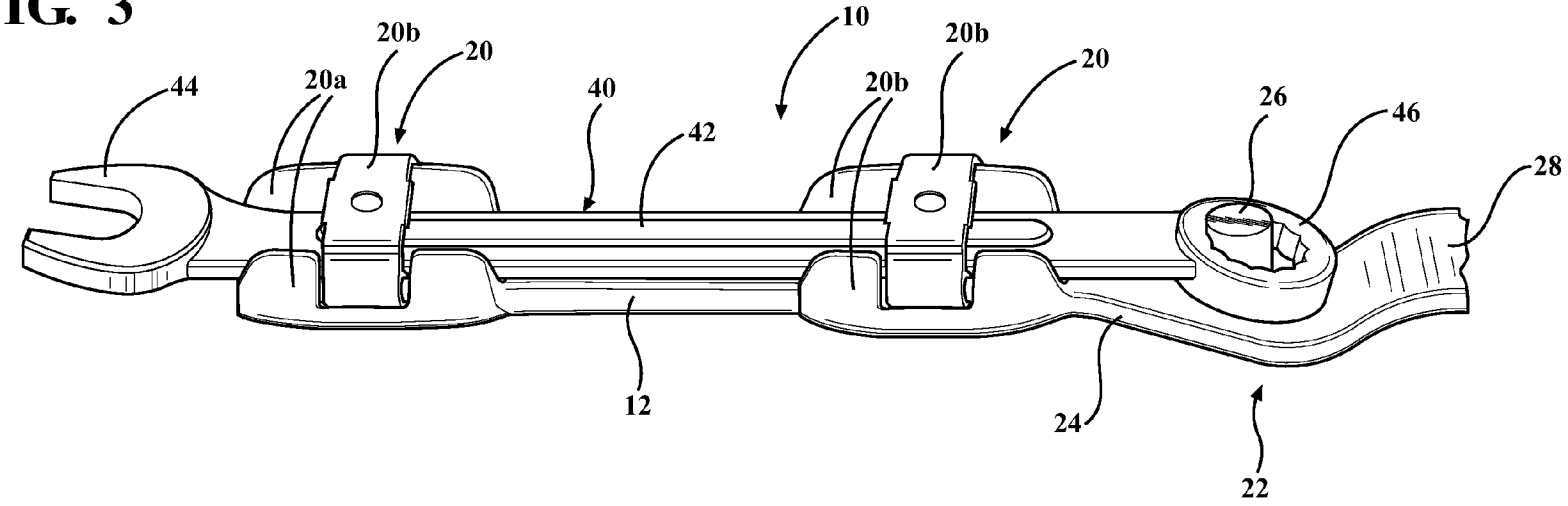
FIG. 3 is similar to FIG. 2, but shows the wrench clamped in place on the extender.
Figure 4:
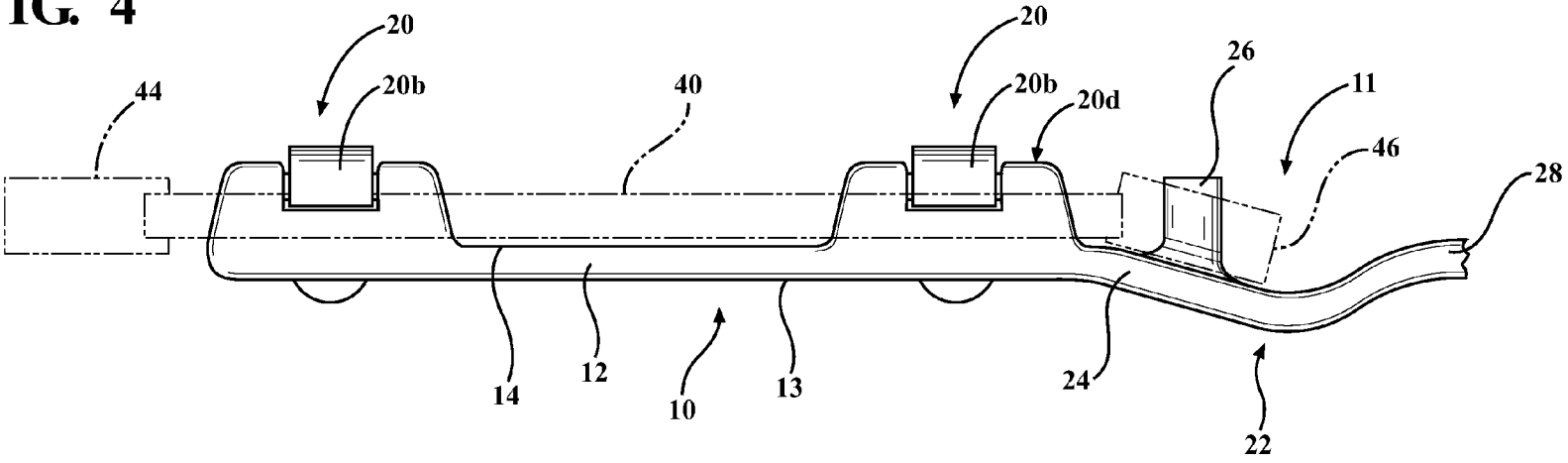
FIG. 4 is a right side elevation view of the extender of FIG. 1, with a box end of the wrench secured linearly in the extender and the open end free for work.

FIG. 2 shows wrench 40 exploded vertically from the upper surface 14 of extender 10, with clamping receptacles 20 open to receive the wrench. FIGS. 3 and 4 show wrench 40 located in clamping receptacles 20 with the receptacles closed, i.e. spring clips 20*b* locked down over the wrench handle. When wrench 40 is secured in receptacles 20, the wrench can be manipulated with the extender at any angle—even upside down—and remain securely attached. Wrench 40 in extender 10 can be effectively used to both tighten and loosen a nut or bolt, whereas the prior art is believed to have focused on loosening. Also, the outer free end of wrench 40 (in the illustrated example the open crescent end 44) can be applied to a nut or bolt with rotational force and with longitudinal force, without shifting in the extender. Clamping receptacles 20 accordingly secure wrench 40 rotationally, preventing the wrench from moving in the plane of handle-supporting base 12, while the compression and/or friction of the receptacle-closing means 20*b* on the wrench handle resists longitudinal shifting.

To further prevent wrench 40 from shifting longitudinally in the receptacles 20, neck 22 is configured to provide a vertical stop at the inner end of the wrench. In a first form shown in FIGS. 1-5, a stop 26 is formed in neck 22 to engage the inner end of the wrench, preventing the wrench from shifting rearwardly toward the grip 28. Stop 26 also prevents the inner end of the wrench (and thus the wrench as a whole) from shifting outwardly away from grip 28, but this is usually not a concern when using a wrench. The stop is substantially vertical, i.e. more vertical than horizontal relative to the plane of base 12, sufficient to prevent longitudinal movement of the wrench in the plane of base 12 toward grip 28.

In the illustrated example of FIGS. 1-5, the box end 46 of the wrench is the "inner" end due to its being secured in neck 22, and the stud 26 projects axially through the box end. Stud 26 has a height sufficient to contact the inner end of the wrench, and preferably extends to a height H (FIG. 4) terminating between the upper surface 14 of base 12 and at or below the height of the upper ends 20*d* of clamping receptacles 20, in order to keep the overall height of the extender 10 to a minimum and improve access to tight spaces when using a wrench secured in the extender.

Neck 22 is offset or angled downwardly relative to handle-supporting base 12 to receive any angled portion of the inner secured end of the wrench 40, such as the angled box-end 46 shown in the example. Since sets of wrenches with angled ends usually come with standard angles, a predetermined neck angle is usually sufficient to accommodate multiple wrenches.

Figure 5:
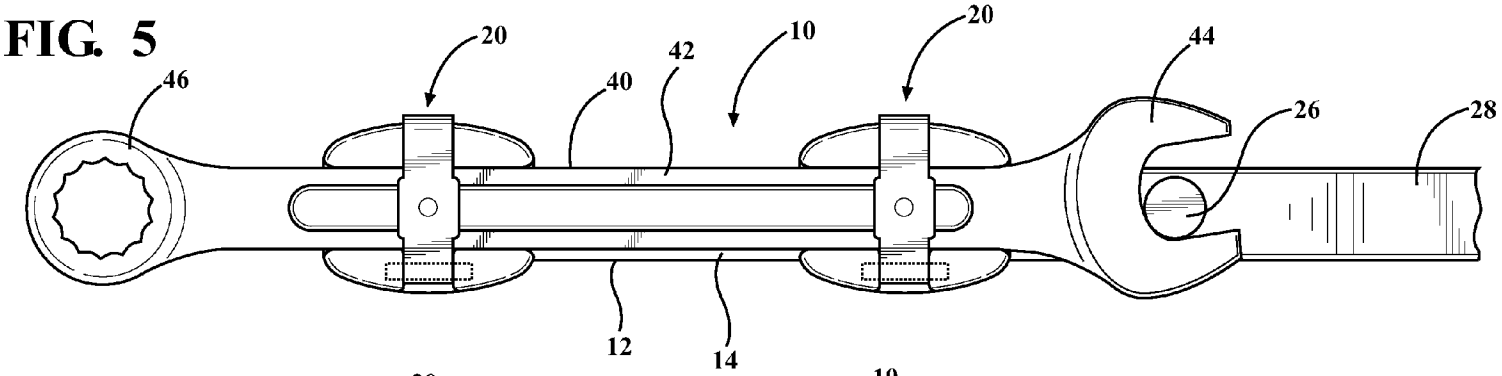
FIG. 5 is a top plan view of the extender of FIG. 1, combined with an open-end wrench.
Figure 6:
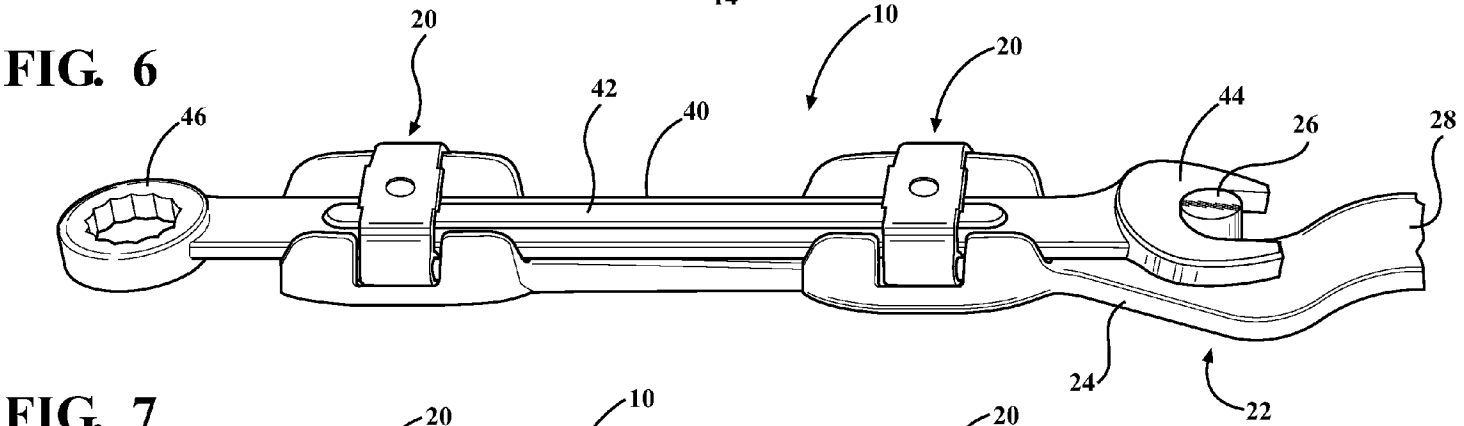
FIG. 6 is a side elevation view of the extender and wrench of FIG. 5.

FIG. 5 shows combination wrench 40 reversed in the extender 10, with open crescent end 44 engaged with stop 26 in neck 22, and closed box end 46 free to engage a nut or bolt. It will be understood that extender 10 can accordingly be combined with wrenches open at both ends, wrenches closed at both ends, or combination wrenches. Extender 10 can also be used with single-ended wrenches, although stud stop 26 may be of limited value with respect to the inner end of the wrench handle.

Figure 7:
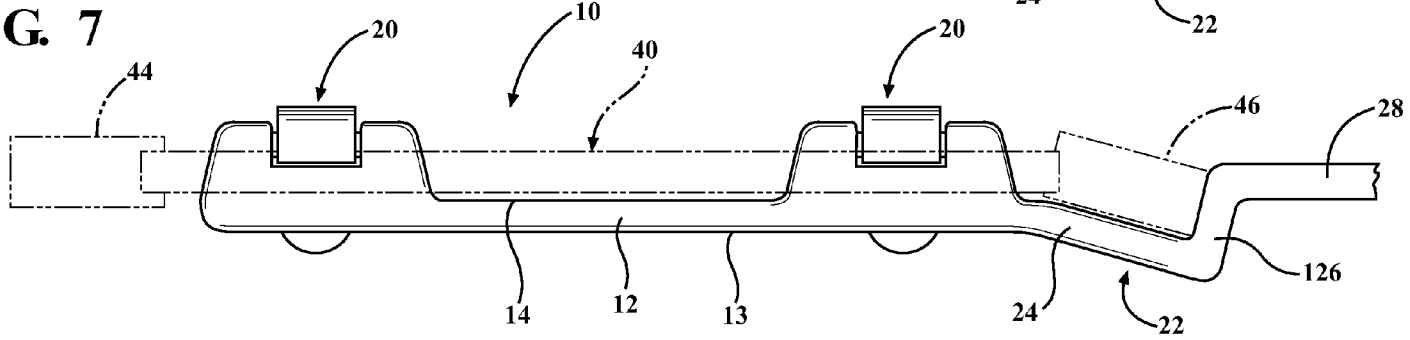
FIG. 7 is a side elevation view of the extender of FIGS. 1-5 with a modified stop surface for the inner end of the wrench.

Referring next to FIG. 7, neck 22 is shown with a modified stop 126 in the form of a substantially vertical inner wall rising from the low point of the neck 22 to the outer end of grip 28. Stop wall 126 is set at a sufficiently vertical angle to positively prevent the end of a wrench from shifting rearwardly toward grip 28 under load. Stop wall 126 is effective with most single- and double-ended wrenches, whether open, closed, or a simple handle end.

In the examples of extender 10 above, grip 28 is substantially aligned with handle-supporting base 12. This alignment keeps the height of the extender above the wrench to a minimum, and also allows more effective use of a wrench secured to the extender. By substantially aligned is meant both true alignment of the base 12 and grip 28 along the same axis, as well as variations in the height of grip 28 above base 12 less than the height of clamping receptacles 20.

Handle-supporting base 12 on extender 10 has a maximum side-to-side width equal to or less than the width of a wrench handle, and the bottom surface 13 (like upper surface 14) is preferably flat. These features maximize clearance and provide a stable base for the body of the wrench.

Description of Operation

In operation, the extender 10 is used by placing a wrench handle 42 in receptacles 20 with an outer end of the wrench (e.g., 44) extending beyond the outer end 16 of the extender, and the inner end of the wrench (e.g., box end 46) extending into neck 22 into engagement with stop 26 (or 126). Receptacle closures 20*b* are closed over the wrench handle 42 to lock the wrench 40 to base 12. A user can then operate the wrench 40 using extender 10 through grip 28, at any angle and in any wrench-turning direction.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention should accordingly be construed by what the above disclosure teaches and suggests to those skilled in the art, and by any claims that the above disclosure supports in this application or in any other application claiming priority to this application.

What is claimed is:

1. A wrench extender apparatus comprising:

a substantially flat handle supporting base comprising an upper wrench-supporting surface, an outer end, an inner end, an elongated vertically-opening clamping receptacle on the upper surface of the base, the clamping receptacle configured to receive a wrench handle vertically therein through an open upper receptacle end, and receptacle closing means associated with the receptacle for selectively closing the open upper end of the receptacle;

an angled neck adjacent the inner end of the base, the neck comprising a downwardly-angled ramp portion extending below the upper surface of the base and a substantially vertical stop, the stop extending upwardly from a location on the neck below the upper surface of the base to a height above the upper surface of the base and terminating at or below a height of the clamping receptacles; and, a grip portion connected to the neck and substantially aligned with the handle-supporting base.

2. The apparatus of claim 1, wherein the clamping receptacle comprises a pair of spaced sidewalls on opposing sides of the base.

3. The apparatus of claim 2, wherein the receptacle closing means includes a wrench-engaging portion extending into the receptacle below upper ends of the sidewalls.

4. The apparatus of claim 3, wherein the wrench-engaging portion comprises a compressible pad.

5. The apparatus of claim 3, wherein the receptacle closing means comprises a pivoting clasp secured to one of the sidewalls, the clasp having a compressible pad secured to a lower surface thereof and extending into the receptacle when the clasp is in a closed position.

6. The apparatus of claim 1, wherein the clamping receptacle comprises two longitudinally spaced clamping receptacles.

7. The apparatus of claim 6, wherein each clamping receptacle comprises a pair of spaced sidewalls on opposing sides of the base.

8. The apparatus of claim 1, wherein the substantially vertical stop comprises a stud projecting from the ramp portion.

9. The apparatus of claim 1, wherein the substantially vertical stop comprises a wall portion extending upwardly from an inner end of the ramp portion and connected to the grip portion.

10. In combination with a wrench having a substantially flat handle and first and second ends, a wrench extender apparatus comprising:

a substantially flat handle supporting base comprising an upper wrench-supporting surface, an outer end, an inner end, an elongated vertically-opening clamping receptacle on the upper surface of the base defining two longitudinally spaced clamping points, the clamping receptacle surrounding lower and side surfaces of the wrench handle and having an open upper receptacle end receiving the wrench handle vertically therein, and receptacle closing means associated with the receptacle for selectively closing the open upper end of the receptacle over the wrench handle, the handle supporting base having a length less than or equal to a length of the wrench handle such that a first end of the wrench extends beyond the outer end of the base and the second end of the wrench extends beyond the inner end of the base;

the second end of the wrench is located in an angled neck portion of the extender adjacent the inner end of the base, the neck comprising a downwardly-angled ramp portion extending below the upper surface of the base and a substantially vertical stop, the stop extending upwardly from a location on the neck below the upper surface of the base to the second end of the wrench to a height above the upper surface of the base and terminating at or below a height of the clamping receptacles; and, a grip portion connected to the neck rearwardly of the vertical stop and substantially aligned with the handle-supporting base.

11. The combination of claim 10, wherein the second end of the wrench is angled relative to the handle at a first angle, and wherein the angle of the ramp portion of the angled neck approximates the first angle of the second end of the wrench.

12. The combination of claim 10, wherein the clamping receptacle comprises a pair of spaced sidewalls on opposing sides of the base.

13. The combination of claim 12, wherein the receptacle closing means includes a wrench-engaging portion extending into the receptacle below upper ends of the sidewalls.

14. The combination of claim 13, wherein the wrench-engaging portion comprises a compressible pad.

15. The combination of claim 13, wherein the receptacle closing means comprises a pivoting clasp secured to one of the sidewalls, the clasp having a compressible pad secured to a lower surface thereof and extending into the receptacle when the clasp is in a closed position.

16. The combination of claim 10, wherein the clamping receptacle comprises two longitudinally spaced clamping receptacles.

17. The combination of claim 16, wherein each clamping receptacle comprises a pair of spaced sidewalls on opposing sides of the base.

18. The combination of claim 10, wherein the substantially vertical stop comprises a stud projecting from the ramp portion.

19. The combination of claim 10, wherein the substantially vertical stop comprises a wall portion extending upwardly from an inner end of the ramp portion and connected to the grip portion.

* * * * *